United States Patent [19]

Johnston

[11] 4,126,573

[45] Nov. 21, 1978

[54] PEROXYACID BLEACH COMPOSITIONS HAVING INCREASED SOLUBILITY

[75] Inventor: James P. Johnston, Montgomery, Ohio

[73] Assignee: The Procter & Gamble Company, Cincinnati, Ohio

[21] Appl. No.: 718,283

[22] Filed: Aug. 27, 1976

[51] Int. Cl.[2] ..... C11D 7/56; C11D 7/38

[52] U.S. Cl. ..... 252/99; 252/95; 252/100; 252/554; 252/558; 252/186; 8/111; 427/212; 427/213; 427/214

[58] Field of Search ..... 252/95, 99, 100, 554, 252/558, 186; 427/212, 213, 214; 8/111

[56] References Cited

U.S. PATENT DOCUMENTS

| | | | |
|---|---|---|---|
| 3,042,621 | 7/1962 | Kirschenbauer | 252/99 |
| 3,441,507 | 4/1969 | Schiefer et al. | 252/95 |
| 3,519,570 | 7/1970 | McCarty | 252/89 X |
| 3,773,673 | 11/1973 | Jenkins et al. | 8/111 X |
| 3,847,830 | 11/1974 | Williams et al. | 252/186 |
| 3,975,280 | 8/1976 | Hachmann et al. | 252/99 X |
| 3,979,318 | 9/1976 | Tokiwa et al. | 427/213 X |
| 3,983,254 | 9/1976 | Alterman et al. | 252/95 X |

*Primary Examiner*—Mayer Weinblatt

*Attorney, Agent, or Firm*—Douglas C. Mohl; Ronald L. Hemingway; Richard C. Witte

[57] ABSTRACT

Improved peroxyacid bleaching particles comprising an inner core of a solid peroxyacid compound and as a coating a surfactant compound. Methods of making and using such particles and compositions containing such particles are also described.

10 Claims, No Drawings

PEROXYACID BLEACH COMPOSITIONS HAVING INCREASED SOLUBILITY

BACKGROUND OF THE INVENTION

This invention relates to peroxyacid bleaching particles comprising an inner core of a solid peroxyacid compound and as a coating a surfactant compound.

Peroxygen bleaching agents in general and peroxyacid compounds in particular have long been recognized as effective bleaching agents for use when the adverse color and fabric damage effects of harsh active halogen bleaching agents cannot be tolerated. See, for example, Canadian Pat. No. 635,620, Jan. 30, 1962, to McCune. Utilization of peroxyacid materials in commercial bleaching products, however, poses several problems. Liquid bleaching compositions containing peroxyacid materials as the active bleaching agent have the tendency to diminish in bleaching effectiveness over prolonged storage periods. Likewise, granular bleaching products containing peroxyacid compounds also tend to lose bleaching activity during storage, as well as pose a safety problem due to their exothermic decomposition properties.

An additional problem present is that the dissolution rate of peroxyacids decreases with shelf life due to the decomposition of the peroxyacid. The decomposition results in formation of the acid used to make the peroxyacid, whose presence causes the solubility rate of the acid/peroxyacid mixture to be reduced to an unacceptable level. The decreased solubility equates with poorer bleaching effectiveness and possible fabric and dye damage which are undesirable.

It has been discovered in the present invention that the solubility of solid peroxyacids can be maintained by coating the peroxyacid particles with a surfactant compound. This development allows the formulator of peroxyacid bleach products to formulate products which maintain bleach effectiveness and fabric safety through improved solubility over an extended shelf period.

It is, therefore, an object of the present invention to provide bleaching particles comprising a peroxyacid compound as an inner core and a surfactant compound as a coating.

It is another object of the present invention to provide a method for making the bleach particles.

It is still another object of the present invention to provide improved bleaching compositions.

It is yet another object of the present invention to provide an improved method for bleaching fabrics.

These and other objects are obtained herein, as will be seen from the following disclosure.

All percentages and ratios herein are by weight unless otherwise designated.

SUMMARY OF THE INVENTION

The present invention relates to bleaching particles comprising an inner core of a solid peroxyacid compound and as a coating a surfactant compound. Bleaching compositions containing such particles are also provided.

In this method aspect, the present invention involves the bleaching of fabrics with the aforementioned bleaching particles and a preferred method for making the particles.

DETAILED DESCRIPTION OF THE INVENTION

The two essential components of the bleaching particles of the present invention are the peroxyacid compound and the surfactant compound. These will be described in turn below, as well as optional components of the compositions.

Peroxyacid Compound

The bleaching component of the instant particles is a normally solid, peroxyacid compound. A compound is "normally solid" if it is in dry or solid form at room temperature. Such peroxyacid compounds are the organic peroxyacids and water-soluble salts thereof which in aqueous solution yield a species containing a $-O-O^-$ moiety. These materials have the general formula $$HO-O-\overset{\overset{\displaystyle O}{\|}}{C}-R-Y$$

wherein R is an alkylene group containing from 1 to about 20 carbon atoms or a phenylene group and Y is hydrogen, halogen, alkyl, aryl or any group which provides an anionic moiety in aqueous solution. Such Y groups can include, for example, $$-\overset{\overset{\displaystyle O}{\|}}{C}-OM\,,\quad -\overset{\overset{\displaystyle O}{\|}}{C}-O-OM \text{ or } -\underset{\underset{\displaystyle O}{\|}}{\overset{\overset{\displaystyle O}{\|}}{S}}-OM$$

wherein M is H or a water-soluble, salt-forming cation. It is preferred that the acids used in the present invention be dried to a moisture level lower than 0.5% and preferably lower than 0.2%.

The organic peroxyacids and salts thereof operable in the instant invention can contain either one or two peroxy groups and can be either aliphatic or aromatic. When the organic peroxyacid is aliphatic, the unsubstituted acid has the general formula $$HO-O-\overset{\overset{\displaystyle O}{\|}}{C}-(CH_2)_n-Y$$

where Y, for example, can be $CH_3$, $CH_2Cl$, $$-\overset{\overset{\displaystyle O}{\|}}{C}-OM\,,\quad -\underset{\underset{\displaystyle O}{\|}}{\overset{\overset{\displaystyle O}{\|}}{S}}-OM \text{ or } -\overset{\overset{\displaystyle O}{\|}}{C}-O-OM\,;$$

and $n$ can be an integer from 1 to 20. Perazelaic acid ($n = 7$) and perdodecanedioic acid ($n = 10$) where Y is $$-\overset{\overset{\displaystyle O}{\|}}{C}-O-OH$$

are the preferred compounds of this type. The alkylene linkage and/or Y (if alkyl) can contain halogen or other noninterfering substituents.

When the organic peroxyacid is aromatic, the unsubstituted acid has the general formula

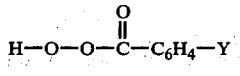

wherein Y is hydrogen, halogen, alkyl,

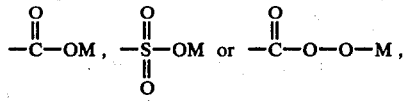

for example. The percarboxy and Y groupings can be in any relative position around the aromatic ring. The ring and/or Y group (if alkyl) can contain any noninterfering substituents such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, m-chloroperoxybenzoic, acid, p-nitroperoxybenzoic acid, and diperoxyisophthalic acid.

Of all the above-described organic peroxyacid compounds, the most preferred for use in the instant compositions are diperdodecanedioic acid and diperazelaic acid.

The amount of the peroxyacid compound used in the compositions containing the surfactant coated bleach particles is an amount sufficient to impart effective bleaching properties to the compositions.

Surfactant Compound

The surfactant compound which is used to coat the peroxyacid in the present invention can be any of the surfactants described hereinafter in the section describing total detergent compositions. The amount of surfactant used to coat the peroxyacid particles is from about 5% to about 100% based on the weight of the peroxyacid and the coated particles have a particle diameter of from about 1 to about 150 microns, preferably from about 5 to about 100 microns.

While any surfactant of the types discussed herein is suitable for use in the present compositions, certain surfactants are preferred for optimum peracid stability. Included in the preferred group of surfactants are anionic sulfate and sulfonate compounds, semipolar amine oxides and phosphine oxides and zwitterionics. Mixtures of members of a particular class or classes of surfactants may also be used.

The sulfate or sulfonate compounds are the most preferred for use herein. Examples of these compounds include, but are not limited to, alkali metal salts of alkyl sulfates or sulfonates wherein the alkyl group has from about 9 to about 22 carbon atoms obtained from fatty alcohols, long chain glycerides or hydrocarbon oils such as paraffin, alkali metal salts of alkyl benzene sulfonates, in which the alkyl group contains from about 9 to about 22 carbon atoms in straight chain or branched chain configuration, e.g., those of the type described in U.S. Pat. Nos. 2,220,099 and 2,477,383, both incorporated herein by reference; alkali metal alkyl glyceryl ether sulfonates; alkali metal alkyl monoglyceride sulfonates and sulfates; alkali metal salts of alkyl phenol ethylene oxide ether sulfate with about 1 to about 10 units of ethylene oxide per molecule; polymeric napthalene sulfonates; and ethoxylated alkyl sulfates or sulfonates. The alkyl benzene sulfonates and alkyl sulfonates as described above are preferred for use herein.

Particle Preparation

The particles of the present invention can be prepared in any number of ways which are known for coating particles. These include spray coating, fluidized bed methods and dispersion methods. The latter methods are preferred for use herein and the method of the present invention involves the dissolving of the surfactant compound in a solvent and dispersing the peroxyacid particles in the solution.

The solvent which is used to dissolve the surfactant compound needs to possess good solvent powers for the surfactant and poor solvent powers for the peroxyacid compound. These characteristics are necessary so that the surfactant is fully dissolved prior to the addition of the peroxyacid and the peroxyacid compound will exist as particles. This allows the peroxyacid particles to be surrounded by the surfactant and when dried will have a surfactant coating.

Solvents which meet the above requirements include water, lower alcohols exemplified by methanol, ethanol and isopropanol and chlorinated solvents such as chloroform. Additionally, mixtures of miscible solvents (e.g., water plus a lower alcohol) can be used advantageously herein. The total amount of solvent used in an amount sufficient to dissolve the surfactant compound. This amount will vary depending upon the particular surfactant/solvent combination.

The process of the present invention involves dissolving the surfactant compound in the solvent medium, dispersing the peroxyacid in the solution and then drying the mixture. In a preferred method the peroxyacid can be predispersed in some of the solvent prior to adding it to the surfactant solution. This helps to insure complete dispersion of the peroxyacid when it is mixed with the surfactant. It is not important whether the peroxyacid particles are added to the surfactant or the surfactant solution to the peroxyacid particles so long as complete dispersion of the particles is accomplished.

Additional Components

In formulating a total composition containing the surfactant coated peroxyacid particles certain additional components are desirable. The compositions containing the peracid compound may contain agents which aid in making the product completely safe, as well as stable. These agents can be designated as carriers.

It is well documented in the peroxyacid literature that peroxyacids are susceptible to a number of different stability problems, as well as being likely to cause some problems. Looking at the latter first, peroxyacids decompose exothermally and when the material is in dry granular form the heat generated must be controlled to make the product safe. The best exotherm control agents are those which are capable of liberating moisture at a temperature slightly below the decomposition temperature of the peroxyacid employed. U.S. Pat. No. 3,770,816, Nov. 6, 1973, to Nielsen, incorporated herein by reference, discloses a wide variety of hydrated materials which can serve as suitable exotherm control agents. Included among such materials are magnesium sulfate $.7H_2O$, magnesium formate dihydrate, calcium sulfate ($CaSO_4.2H_2O$), calcium lactate hydrate, calcium sodium sulfate ($CaSO_4.2Na_2SO_4.2H_2O$), hydrated forms of such things as sodium aluminum sulfate, potassium aluminum sulfate, ammonium aluminum sulfate and aluminum sulfate. Preferred hydrates are the alkali metal aluminum sulfates, particularly preferred is potassium aluminum sulfate. Other preferred exotherm control agents are those materials which lose water as the result of chemical decomposition such as boric acid, malic acid and maleic acid. The exotherm control agent is preferably used in an amount of from about 100% to about 200% based on the weight of the peroxyacid compound.

The other problems faced when peroxyacid compounds are used fall into the area of maintaining good bleach effectiveness. It has been recognized that metal ions are capable of serving as catalyzing agents in the degradation of the peroxyacid compounds. To overcome this problem chelating agents can be used in an amount ranging from 0.005% to about 1.00% based on the weight of the composition to tie up heavy metal ions. U.S. Pat. No. 3,442,937, May 6, 1969, to Sennewald et al., discloses a chelating system comprising quinoline or a salt thereof, an alkali metal polyphosphate and, optionally, a synergistic amount of urea. U.S. Pat. No. 2,838,459, June 10, 1958, to Sprout, Jr., discloses a variety of polyphosphates as stabilizing agents for peroxide baths. These materials are useful herein as stabilizing aids. U.S. Pat. No. 3,192,255, June 29, 1965, to Cann, discloses the use of quinaldic acid to stabilize percarboxylic acids. This material, as well as picolinic acid and dipicolinic acid, would also be useful in the compositions of the present invention. A preferred chelating system for the present invention is a mixture of 8-hydroxyquinoline and an acid polyphosphate preferably acid sodium pyrophosphate. The acid polyphosphate can be a mixture of phosphoric acid and sodium pyrophosphate wherein the ratio of the former to the latter is from about 0.5:1 to about 2:1 and the ratio of the mixture to 8-hydroxyquinoline is from about 0.2:1 to about 5:1.

In addition to the above-mentioned chelating systems to tie up heavy metals in the peroxyacid compositions, coating materials may also be used to extend the shelf life of dry granular compositions. Such coating materials may be, in general, acids, esters, ethers and hydrocarbons and include such things as wide varieties of fatty acids, derivatives of fatty alcohols such as esters and ethers, derivatives of polyethyleneglycols such as esters and ethers and hydrocarbon oils and waxes. These materials aid in preventing moisture from reaching the peracid compound. Secondly, the coating may be used to segregate the surfactant coated peracid particles from other agents which may be present in the composition and adversely affect the peracid's stability. The amount of the coating material used is generally from about 2.5% to about 15% based on the weight of the peroxyacid compound.

Additional agents which may be used to aid in giving good bleaching performance include such things as pH adjustment agents, bleach activators and minors such as coloring agents, dyes and perfumes. Typical pH adjustment agents are used to alter or maintain aqueous solutions of the instant compositions within the 5 to 10 pH range in which peroxyacid bleaching agents are generally most useful. Depending upon the nature of other optional composition ingredients, pH adjustment agents can be either of the acid or base type. Examples of acidic pH adjustment agents designed to compensate for the presence of other highly alkaline materials include normally solid organic and inorganic acids, acid mixtures and acid salts. Examples of such acidic pH adjustment agents include citric acid, glycolic acid, tartaric acid, gluconic acid, glutamic acid, sulfamic acid, sodium bisulfate, potassium bisulfate, ammonium bisulfate and mixtures of citric acid and lauric acid. Citric acid is preferred by virtue of its low toxicity and hardness sequestering capability.

Optional alkaline pH adjustment agents include the conventional alkaline buffering agents. Examples of such buffering agents include such salts as carbonates, bicarbonates, silicates, pyrophosphates and mixtures thereof. Sodium bicarbonate and tetrasodium pyrophosphate are highly preferred.

Optional peroxyacid bleach activators as suggested by the prior art include such materials as particular aldehydes and ketones. Use of these materials as bleaching activators is described more fully in U.S. Pat. No. 3,822,114, July 2, 1974, to Montgomery, incorporated herein by reference.

A preferred dry, granular bleaching product employing the peroxyacid bleach of the present invention involves combining the active surfactant coated peroxyacid particles with potassium aluminum sulfate or boric acid and the acid pyrophosphate/8-hydroxyquinoline mixture and subsequently coating this mixture with mineral oil and agglomerating the coated particles with a polyethylene glycol derivative. Sodium sulfate may be included as an optional ingredient to aid in dispersing the peroxyacid compound. An alkaline pH adjustment agent is then added to the agglomerated stabilized active as a dry mix.

Optional ingredients, if utilized in combination with the active peroxyacid/surfactant system of the instant invention to form a complete bleaching product, comprise from about 20% to about 99% by weight of the total composition. Conversely, the amount of bleaching system is from about 1% to about 80% of the composition.

The bleaching compositions of the instant invention, particularly the dry granular version, can also be added to and made a part of conventional fabric laundering detergent compositions. Accordingly, optional materials for the instant bleaching compositions can include such standard detergent adjuvants as surfactants and builders. Optional surfactants are selected from the group consisting of organic anionic, nonionic, ampholytic and zwitterionic surfactants and mixtures thereof. Optional builder materials include any of the conventional organic and inorganic builder salts including carbonates, silicates, acetates, polycarboxylates, and phosphates. If the instant stabilized bleaching compositions are employed as part of a conventional fabric laundering detergent composition, the instant bleaching system generally comprises from about 1% to about 40% by weight of such conventional detergent compositions. Conversely, the instant bleaching compositions can optionally contain from about 60% to about 99% by weight of conventional surfactant and builder materials. Further examples of suitable surfactants and builders are given below.

Water-soluble salts of the higher fatty acids, i.e., "soaps", are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Semi-polar surfactants useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

The instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builders salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product.

Specific examples of materials capable of forming the water-insoluble reaction product include the water-soluble salts of carbonates, bicarbonates, sequicarbonates, silicates, aluminates and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference.

Composition Preparation

The bleaching compositions of the instant invention are prepared in any conventional manner such as by admixing ingredients, by agglomeration, by compaction or by granulation. In one method for preparing such compositions, a mixture of surfactant coated peroxyacid particles and water, the mixture containing from about 50% by weight to about 80% by weight of water, is combined in proper proportions with optional components to be utilized within the bleaching granules themselves. Such a combination of ingredients is then thoroughly mixed and subsequently run through an extruder. Extrudate in the form of noodles is then fed into a spheronizer (also known by the trade name, Marumerizer) to form approximately spherical granules containing the surfactant coated peroxyacid particles. The bleaching granules can then be dried to the appropriate water content. Upon leaving the spheronizer, such granules are screened to provide uniform granules.

Bleaching granules prepared in this manner can then be admixed with other granules of optional bleaching or detergent composition materials. Actual particle size of either the bleach-containing granules or optional granules of additional material is not critical. If, however, compositions are to be realized having commercially acceptable flow properties, certain granule size limitations are highly preferred. In general, all granules of the instant compositions preferably range in size from about 100 microns to 3000 microns, more preferably from about 100 microns to 1300 microns.

Additionally, flowability is enhanced if granules of the present invention are of approximately the same size. Therefore, preferably the ratio of the average granule sizes of the bleach-containing granules and optional granules of other materials varies between 0.5:1 and 2.0:1.

Bleaching compositions of the present invention are utilized by dissolving them in water in an amount sufficient to provide from about 1.0 ppm to 100 ppm available oxygen in solution. Generally, this amounts to about 0.01% to 0.2% by weight of composition in solution. Fabrics to be bleached are then contacted with such aqueous bleaching solutions.

The bleaching compositions of the instant invention are illustrated by the following examples:

EXAMPLE I

Particles of the present invention are prepared by dissolving 2.3 grams of sodium alkyl ($C_{13}$) benzene sulfonate in 30 grams of water followed by thoroughly dispersing in 11.5 grams of finely divided diperoxydodecanedioic acid and subsequently drying the mixture. The dried particles have a surfactant coating and are from about 5 to about 150 microns in diameter.

EXAMPLE II

The following test is conducted to measure the solubility of the peroxyacid particles of Example I.

An amount of the particles sufficient to supply 20 ppm of diperoxydodecanedioic acid is added to one liter of water which has one gram of a typical anionic detergent dissolved in it and the dispersion is mixed for ten minutes at 70° F. The total solution/dispersion is filtered and the filtrate is analyzed for the amount of the peroxyacid dissolved.

The same procedure as described above in followed for diperoxydodecanedioic acid particles without the alkyl benzene sulfonate coating.

The following solubility results are obtained for the above-described systems. The mixture of the present invention is identified as Sample A. The storage times indicate the time the dry sample has been stored at 120° C. prior to being tested.

| | Dissolved Peroxyacid (ppm) | |
|---|---|---|
| Days Stored at 120° F | Sample A | Sample B |
| 0 | 18 | 10 |
| 1 | 17 | 9 |
| 2 | 15 | 9 |
| 8 | 14 | — |

It is seen that the solubility of the particles of the present invention is superior to the solubility of the peroxyacid alone, not only initially but after storage at 120° F.

Results similar to those shown above are obtained when other peroxyacids such as diperoxyazelaic acid are used in place of diperoxydodecanedioic acid and a different surfactant is used.

What is claimed is:

1. Peroxyacid bleaching particles consisting essentially of:

(a) an inner core of a solid peroxyacid compound selected from the group consisting of diperoxyazelaic acid and diperoxydodecanedioic acid, and (b) as a coating a water-soluble surfactant compound selected from the group consisting of organic anionic sulfate compounds, anionic sulfonate compounds, semipolar amine oxides, semipolar phosphine oxides and zwitterionic compounds, said surfactant being present in an amount of from about 5% to about 100% of said peroxyacid and the coated particles having a particle diameter of from about 1 to about 150 microns.

2. The composition of claim 1 wherein the water-soluble surfactant (b) is selected from the group consisting of alkali metals salts of alkyl benzene sulfonates and alkyl sulfonates having alkyl groups from about 9 to about 22 carbon atoms.

3. The composition of claim 2 wherein the water-soluble surfactant (b) is sodium alkyl ($C_{13}$) benzene sulfonate.

4. The composition of claim 3 wherein the solid peroxyacid (a) is diperoxydodecanedioic acid.

5. The composition of claim 1 additionally comprising from about 100% to about 200% of a moisture liberating exotherm control agent based on the weight of the peroxyacid compound, said exotherm control agent being selected from the group consisting of magnesium sulfate $.7H_2O$, magnesium formate dihydrate, calcium sulfate dihydrate, calcium lactate hydrate, calcium sodium sulfate dihydrate, hydrated sodium aluminium sulfate, hydrated potassium aluminum sulfate, hydrated ammonium aluminum sulfate, hydrated aluminum sulfate, boric acid, malic acid, maleic acid and mixtures thereof.

6. The composition of claim 5 wherein the moisture liberating exotherm control agent is boric acid.

7. The composition of claim 6 wherein the water-soluble surfactant (b) is selected from the group consisting of alkali metal salts of alkyl benzene sulfonates and alkyl sulfonates having alkyl groups from about 9 to about 22 carbon atoms.

8. The composition of claim 7 wherein the water-soluble surfactant (b) is sodium alkyl ($C_{13}$) benzene sulfonate.

9. The composition of claim 8 wherein the solid peroxyacid (a) is diperoxydodecanedioic acid.

10. A method of bleaching fabrics comprising contacting fabrics to be bleached with a water solution containing peroxyacid bleaching particles consisting essentially of:

(a) an inner core of a solid peroxyacid compound selected from the group consisting of diperoxyazelaic acid and diperoxydodecanedioic acid, and (b) as a coating a water-soluble surfactant compound selected from the group consisting of anionic sulfate compounds, anionic sulfonate compounds, semipolar amine oxides, semipolar phosphine oxides and zwitterionic compounds, said surfactant being present in an amount of from about 5% to about 100% of said peroxyacid and the coated particles having a particle diameter of from about 1 to about 150 microns, sufficient to provide from about 1 ppm to about 100 ppm available oxygen.

* * * * *